US006402120B1

(12) United States Patent
Swaab

(10) Patent No.: US 6,402,120 B1
(45) **Date of Patent: *Jun. 11, 2002**

(54) APPARATUS FOR BLENDING AND FABRICATING PERSONALIZED LIPSTICK

(75) Inventor: Mary Swaab, Rockford, IL (US)

(73) Assignee: Graf Enterprises, LLC, Rockford, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/363,129

(22) Filed: Jul. 28, 1999

Related U.S. Application Data

(63) Continuation-in-part of application No. 08/924,196, filed on Sep. 5, 1997, now Pat. No. 5,971,351.

(51) Int. Cl.[7] ..... B29C 39/00

(52) U.S. Cl. ..... 249/117; 206/568; 206/575; 206/581; 249/119; 249/170; 401/DIG. 1; 425/DIG. 32

(58) Field of Search ..... 249/53 R, 102, 249/117, 119, 170; 425/DIG. 32, 803; 206/568, 575, 581; 401/DIG. 1; 434/103

(56) References Cited

U.S. PATENT DOCUMENTS

| | | | | |
|---|---|---|---|---|
| 1,799,524 A | | 4/1931 | Morgan | |
| 2,192,675 A | | 3/1940 | Ferentzy | |
| 2,878,590 A | | 3/1959 | Dodge | |
| 3,453,056 A | | 7/1969 | Motsavage et al. | 401/88 |
| 3,628,260 A | | 12/1971 | Jacobsen | |
| 3,722,109 A | | 3/1973 | Jacobson | |
| 3,740,810 A | | 6/1973 | Austin | 29/200 |
| 3,815,265 A | | 6/1974 | DePauw | |
| 4,249,318 A | | 2/1981 | Anderson et al. | 434/103 |
| 4,337,046 A | | 6/1982 | Anderson et al. | 434/103 |
| 4,587,072 A | | 5/1986 | Ohtomo et al. | 264/297.8 |
| 4,705,051 A | | 11/1987 | Bacon et al. | 132/79 |
| 4,739,778 A | | 4/1988 | Christie | 132/88.7 |
| 4,813,801 A | | 3/1989 | Cardia | 401/71 |
| 5,031,764 A | | 7/1991 | Meador et al. | 206/232 |
| 5,209,664 A | | 5/1993 | Wilcox | 434/103 |
| 5,780,018 A | | 7/1998 | Collins et al. | 424/64 |
| 5,971,351 A | * | 10/1999 | Swaab | 249/117 |

FOREIGN PATENT DOCUMENTS

| | | | |
|---|---|---|---|
| CH | 253120 | 11/1948 | 425/DIG. 32 |
| EP | 0578179 A1 | 1/1994 | 425/DIG. 32 |

OTHER PUBLICATIONS

Statement of Attorney Regarding On–Sale Information.

* cited by examiner

*Primary Examiner*—James P. Mackey
(74) *Attorney, Agent, or Firm*—Leydig, Voit & Mayer, Ltd

(57) ABSTRACT

An apparatus and method for custom blending and fabricating lipstick to the specific demands of individual customers. The present invention provides a kit which enables a user to blend various pigments to arrive at a very specific shade, and then blend the desired shade with a specific base to result in a desired consistency of lipstick, and which also allows the blended bases and pigments to be heated to a liquefied form and poured into a mold for hardening. Upon cooling and hardening, a conventional lipstick case can be attached to the lipstick for removal from the mold and use by the customer. The present invention therefore not only allows a user to quickly attain the specific shade and consistency of lipstick desired, but also eliminates the time consuming and unsatisfactory process of visiting multiple stores having expansive inventories of variously shaded and textured lipsticks.

29 Claims, 4 Drawing Sheets

APPARATUS FOR BLENDING AND FABRICATING PERSONALIZED LIPSTICK

This is a continuation-in-part of application Ser. No. 08/924,196, filed on Sep. 5, 1997, now U.S. Pat. No. 5,971,351.

FIELD OF THE INVENTION

The present invention generally relates to cosmetics, and more particularly relates to apparatus and methods for creating lipsticks.

BACKGROUND OF THE INVENTION

When a person is desirous of purchasing cosmetics, he or she is often confronted with a time consuming and very often unsatisfactory process. Retail outlets often carry only a limited number of manufacturers and their product lines, and if a customer cannot find the particular shade or consistency of lipstick desired, he or she will be required to visit additional retail outlets in search of another manufacturer and its product line which may or may not provide the particular shade or consistency of lipstick desired. Even after finding an acceptable lipstick, it is often shortlived in that the manufacturer may discontinue production of the desired type.

Alternatively, the customer can resort to catalogs or other written material which will provide the customer with an expansive list of information and possibly the particular shade and consistency of lipstick desired. However, the shade as it appears in printed form on the advertisement may be quite different from the shade when worn and viewed in ambient lighting conditions as opposed to the printed conditions of the catalog.

Such a system is not only frustrating and unsatisfactory to the client, but can also be unsatisfactory to the retailer and manufacturer. The retailer is required to maintain an expansive line of lipstick in inventory which may or may not turn over in profitable fashion, which necessarily limits the retailer to carrying only the best selling lines, or most cost-effective lines. The retailer will therefore not be able to fully satisfy all the needs of his or her client base. From the manufacturer standpoint, such a system is unsatisfactory in the sense that its product lines will be only carried in a few retail outlets which necessarily limits the total client base to which the manufacturer can extend its goods.

Certain areas of the cosmetics industry have therefore recognized this deficiency in the current system and devised alternatives to more closely tailor cosmetic products to the specific desires of the given customer. For example, U.S. Pat. No. 5,031,764, issued to Meador, et al, discloses an apparatus for designing personalized perfume by providing a system of tapered strips along with a family of fragrances. An individual is therefore able to use the apparatus of Meador '764 to design customized perfume or cologne in relatively quick fashion.

However, while systems such as the Meador '764 patent do provide a system by which personalized perfumes and colognes can be created, no system currently exists to create personalized or specially tailored cosmetics corresponding to the exact demands of each customer, and more specifically to the focus of the present invention, no system or method currently exists to allow specific shades, consistencies and textures of lipsticks to be created based on the specific demands of each customer. It therefore follows that no system currently exists to allow for customized lipstick creation in a relatively short time frame, without relying on a system of ordering and waiting for delivery from an off-site warehouse.

SUMMARY OF THE INVENTION

It is therefore a primary aim of the present invention to provide an apparatus and method for custom blending lipstick to a desired shade, consistency and content, and fabricating the blended lipstick while the customer waits.

It is an objective of the present invention to provide a kit for use by cosmetic retailers which can be used to custom blend a particular shade and consistency of lipstick to the exact and immediate demands of the customers, and with which a conventional retractable lipstick case can be fabricated with the custom blended lipstick therein while the customer waits.

It is another objective of the present invention to provide a kit for personal use which can be used to custom blend lipstick at home or various other locations away from retail establishments.

It is another objective of the present invention to provide a kit which not only allows the specific color of the lipstick to be blended, but which also allows various additives, such as moisturizers, sunscreens, fragrances, and frostings, to be added to the resulting lipstick.

It is another objective of the present invention to provide a kit for creating custom blended lipstick which provides a means by which the exact portions of the various colored pigments, bases, and additives can be measured and recorded to allow for additional batches of lipstick to be created after a specific combination and recipe has been established.

It is still another objective of the present invention to provide a kit which allows the custom blended lipstick to be blended and manufactured in a matter of minutes.

It is still another objective of the present invention to provide a kit and method which allows for custom blending and fabrication of lipstick in a consistent and repeatable manner.

In accordance with these aims and objectives, the present invention is directed towards a kit for custom blending lip coloring products such as lipstick, lip gloss and the like to desired shade, texture, and content, either at home or in a retail store. The kit includes multiple containers of different pigments, at least one container of a suitable base, a means for measuring the pigments and/or bases, and a mold for receiving blended, heated and liquefied combination of pigments and bases. The kit is typically packaged together in a sellable package which can be used in either a retail store or a home. The size and variety of the containers of pigments and bases can be adapted to meet the particular consumer needs.

It is a feature of the present invention to provide a kit for custom blending lipstick to a desired shade, texture, and content, and fabricating the blended lipstick into a conventional lipstick case, wherein the kit includes a plurality of pigments, a plurality of bases, a means for measuring predetermined quantities of the pigments and bases, a blending sheet on which the measured quantities of pigments and bases can be mixed, a means for heating the desired blend into a liquefied form, a mold for receiving the liquefied blend and hardening the blend into a solid form, and a plurality of extendible and retractable lipstick cases adapted to receive the hardened lipstick.

It is another feature of the present invention to provide such a kit wherein the means for measuring is a planar sheet which includes a plurality differently sized segments onto which the pigments can be poured for exact measurement.

It is another feature of the present invention to provide such a kit wherein the blending sheet is a translucent sheet adapted to be positioned over the measurement sheet having the graduated segments. The graduated segments are visible through the translucent blending sheet to allow for simultaneous measuring and mixing of the pigments.

It is yet another feature of the present invention to provide such a kit wherein the mold includes a clam shell type housing adapted to be folded into mating orientation to form a plurality of cavities having the shape of a desired lipstick. The clam shell can be unfolded upon hardening of the lipstick for removal thereof, and is preferably manufactured from a metal to serve as an effective heat sink. In alternative embodiments, the mold can be made of other materials including plastic.

It is still another feature of the present invention to provide such a mold wherein each lipstick cavity is treated with a non-stick coating to facilitate removal of the hardened lipstick therefrom.

It is still another feature of the present invention to provide a method for custom blending and fabricating of lipstick to the personal specifications of each customer wherein the method comprises the steps of selecting, measuring, and mixing measured quantities of pigments to arrive at a desired shade, adding the desired shade of pigment blend to a particular base having the consistency of the desired lipstick, heating the desired pigments and bases to a liquefied form, pouring the liquefied pigment and bases into a mold having the shape of the desired lipstick, and affixing a lipstick case to the hardened lipstick upon removal from the mold.

These and other aims, objectives, and features of the present invention will become more apparent from the following detailed description when taken in conjunction with the accompanying drawings.

Figure 1:
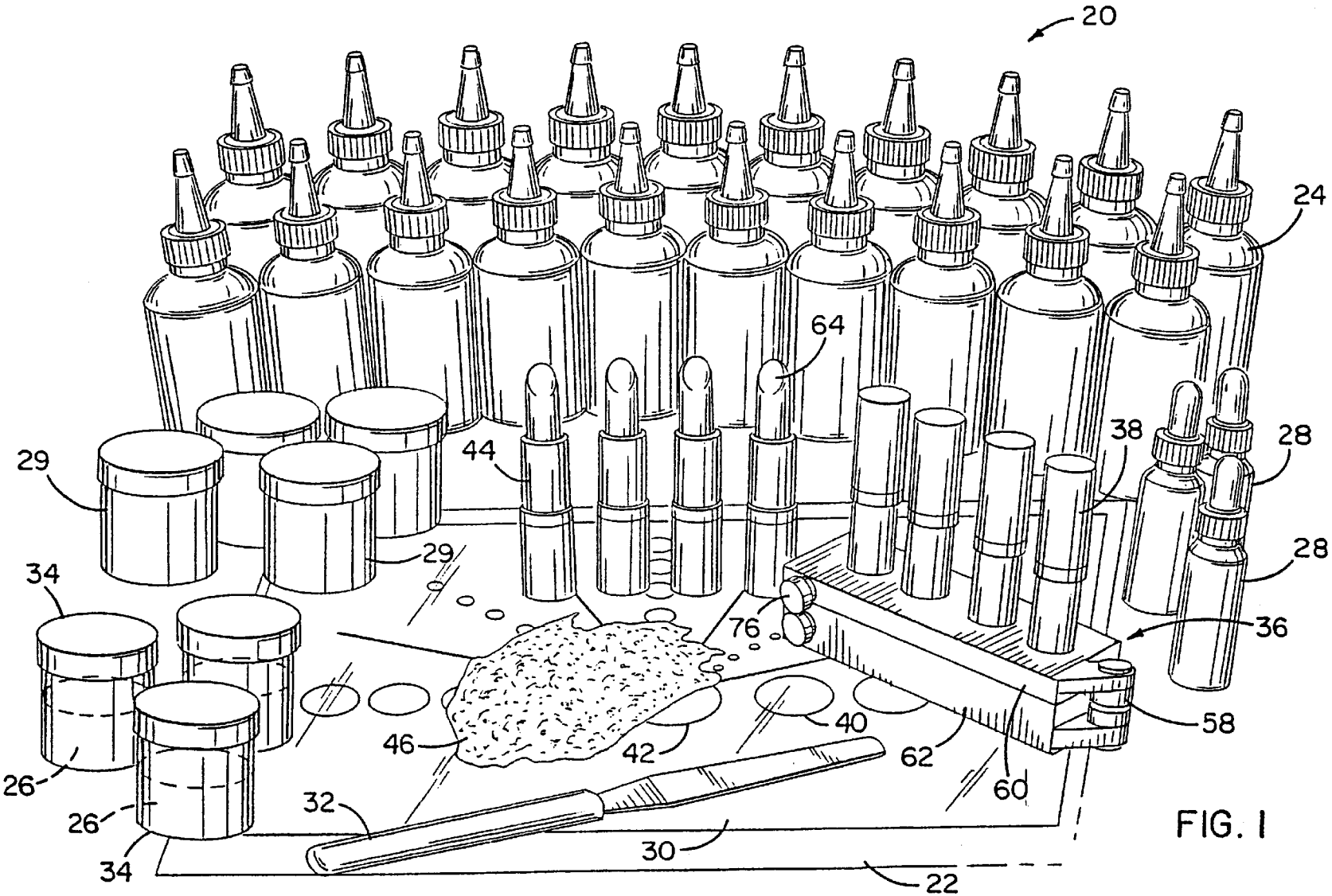
FIG. 1 is a perspective view of the preferred embodiment of the present invention.

While the present invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and with specific reference to a FIG. 1, the preferred embodiment is shown and is generally designated as kit 20. As shown therein, kit 20 includes graduated measuring sheet 22, pigments 24, bases 26, additives 28, frostings 29, blending sheets 30, mixing tool 32, heating vessel 34, mold 36 and lipstick cases 38. It is to be understood that the actual number of pigments 24, bases 26, additives 28, frostings 29, blending sheets 30, and lipstick cases 38 provided with each kit 20 can certainly vary, but that the stated elements are all included in the preferred embodiment of the present invention. It is also to be understood that in alternative embodiments, additional additives can be included with kit 20 to further enhance the variability of the lipstick. As indicated in the drawings, the kit 20 is typically packaged together in a sellable package which may be used in either a retail store or a home. The size and variety of the containers of pigments and bases can be adapted to meet the particular consumer needs.

Figure 2:
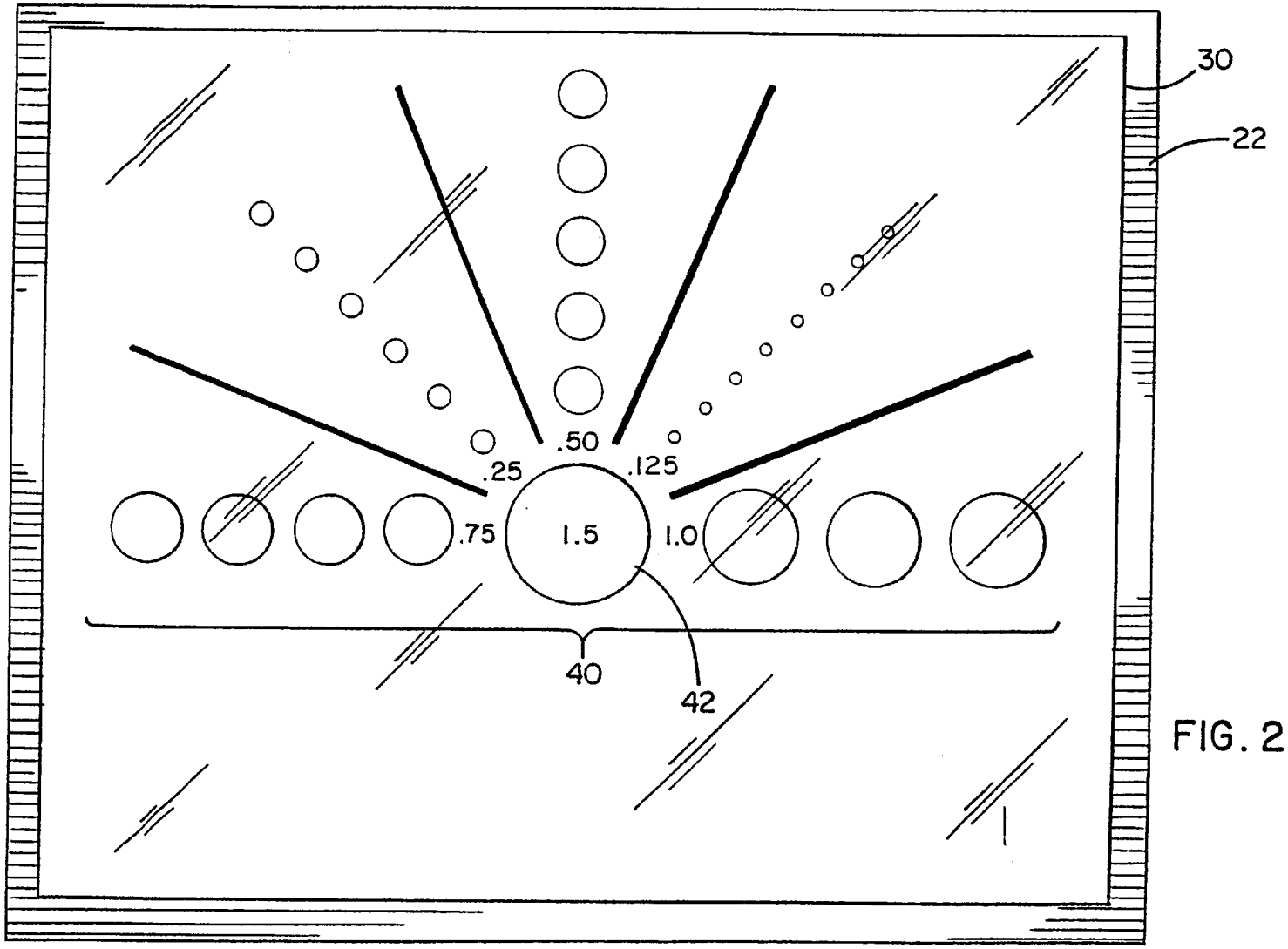
FIG. 2 is a plan view of the measuring sheet and the blending sheet used in conjunction with the preferred embodiment of the present invention.

With specific reference now to measuring sheet 22, FIG. 2 shows that measuring sheet 22 is a planar sheet which in the preferred embodiment is preferably manufactured from acrylic, but which could alternatively be made of a relatively heavy grade of paper or possibly a light grade of cardboard. In alternative embodiments, different means for measuring can be provided which need not take the specific form of that shown in FIG. 2. However, as shown in FIG. 2, measuring sheet 22 also includes a plurality of graduated segments 40 into which pigments 24 can be poured. In the preferred embodiment, one graduated segment 40 having a nominal denotation of 1.5 is provided in a central position with sets of graduated segments ranging from nominal denotations of 0.125 to 1.0 shown radiating out from central segment 42. In alternative embodiments, segments 40 need not be provided in the specific dimensions shown in FIG. 2, but rather can be provided in any size providing a means by which the components can be consistently measured into predetermined quantities of pigments 24. Other appropriate measuring means may include scoops, spoons, scales, droppers, measuring cups, metering devices, and other similar measuring devices.

In order to reduce the overall cost of kit 20, only one measuring sheet 22 is provided with each kit, but through the novel use of translucent blending sheets 30, measuring sheet 22 can be used in repetition. In other words, blending sheet 30 can be placed over a measuring sheet 22 such that graduated segments 40 are visible through translucent blending sheet 30. While blending sheet 30 is depicted in the drawings as being smaller than measuring sheet 22, such depiction is only for the purposes of clearer illustration, in that blending sheet 30 is actually the same size as measuring sheet 22 in the preferred embodiment. The retailer can pour pigments 24 directly onto translucent blending sheet 30 using the graduated segments 40 of measuring sheet 22 as a guide. The measured quantity of pigment 24 can then be moved to a separate and distinct area of blending sheet 30 for subsequent combination with additional pigments 24. For example, one pigment 24 having a particular red hue can be measured using one of the graduated segments 40 and if it is desired to create a resulting lipstick 44 having a relatively orange appearance, a pigment having a yellow hue can be measured and added. This process can be repeated using the various shades of pigments 24 provided with kit 20 until the specific shade desired by the customer is achieved.

While the list of particular pigments 24 provided with each kit 20 can vary greatly with each kit 20 sold, in the preferred embodiment twenty distinct pigments are provided, each in its own respective container as indicated in the drawings. The exact chemical compound used to create each pigment 24 is not of importance to the present invention, but rather the shades, or family of shades, is of importance to the present invention. Toward that end, four distinct family of shades are provided, namely: cool shades, i.e., blackberry, wineberry, ruby red, and magenta; warm shades, i.e., coral, crimson, paprika, flame, tangerine, peach, and russet; brown shades, i.e., brown, mahogany, and cocoa; and toner shades, i.e., white, black, ochre, marigold, sapphire, and blueberry. It is to be understood that through the provision of such a wide variety of pigments 24 a resulting family of lipstick shades numbering in the thousands can be achieved.

In addition to pigments 24, a variety of bases 26 are also provided, each base 26 being contained in its own individual container as illustrated in the drawings. In the preferred embodiment, the bases include a cream base used to create a relatively moist, sheer, or frosted lipstick, a matte base used to create a long lasting lipstick, and a butter base, used to create an extremely sheer and glossy lipstick. Again, the exact chemical composition of the bases 26 are not of particular relevance to the present invention, but rather it is to be understood that bases 26 are used primarily to create the texture and consistency of the resulting lipstick 44, whereas pigments 24 are used to create the specific color of lipstick 44. While bases 26 of the preferred embodiment are not shaded, alternative embodiments could include a larger number of bases already pre-colored to a particular hue. The pre-colored bases could then provide a starting point to which colored pigments could be added.

With regard to additives 28 and frostings 29, the preferred embodiment of the present invention includes a variety of additives which can be added to the blended pigments 24 and bases 26 to alter the characteristics of lipstick 44. For example, a moisture additive including known moisturizers such as oils and vitamins can be provided, a sunscreen additive having a specific sun protection factor (SPF) can be added, or a frost additive used to create a specific texture or reflective appearance can also be added. A frost additive is considered to be a pigment as understood by those skilled in the art and is often in powdered form and measured by scoops. For lip coloring products such as lip gloss, frosts may be the only type of pigment in the kit. Moreover, if it is desired to have a particular fragrance or flavor in accompaniment to the specific shade of lipstick 44, various scents or flavors can be added as well. Such additives 28 and frostings 29, would be added to pigments 24 and bases 26 in the same manner as mentioned above or according to the preferred method herein described. Any variety of tools can be used to dispense the additives including scoops, brushes, and droppers.

Upon arriving at the particular shade, of the desired lipstick 44, the resulting blend 46, in the preferred method, can be deposited into heating vessel 34 already containing base 26 for subsequent heating and liquefaction. Bases 26 are preferably provided in heating vessel 34 in sufficient quantity to form two (2) lipsticks, however, it is to be understood that different quantities can be provided. It is also to be understood that bases 26 can be mixed with blend 46 on blending sheet 30 if desired and then deposited into heating vessel 34 for liquefaction. To perform this function, mixing tool 32 or an alternative tool can be used to scrape blend 46 from the blending sheet 30 and into heating vessel 34. Blending sheet 30 can then be removed and thrown away to leave measuring sheet 22 ready for subsequent uses.

In normal operation, the specific quantities of pigments 24, bases 26, additives 28 and frostings 29 would be recorded using a recordation sheet to memorialize the specific composition of blend 46. In order to transform blend 46 into the shape of a conventional lipstick 44, heating vessel 34 is heated to a temperature sufficient to liquefy blend 46 and base 26. In the preferred embodiment, this is performed through the use of a conventional microwave oven preferably having a maximum power output of 600–650 watts. Under normal circumstances using such an oven a heating time of approximately sixty seconds will be sufficient to adequately liquefy the composition. Other suitable heating means that can also be used with the kit of the present invention include a heating block, a steam bath, a water bath, a conventional oven, a flame, a hot air blower, any number of electrical heating devices (such as a hot light), or other such heating mechanisms known in the art. In any event, it is understood that the heating means is typically not sold with the kit but is a device that the buyer of the kit typically already has at their home or store.

Figure 3:
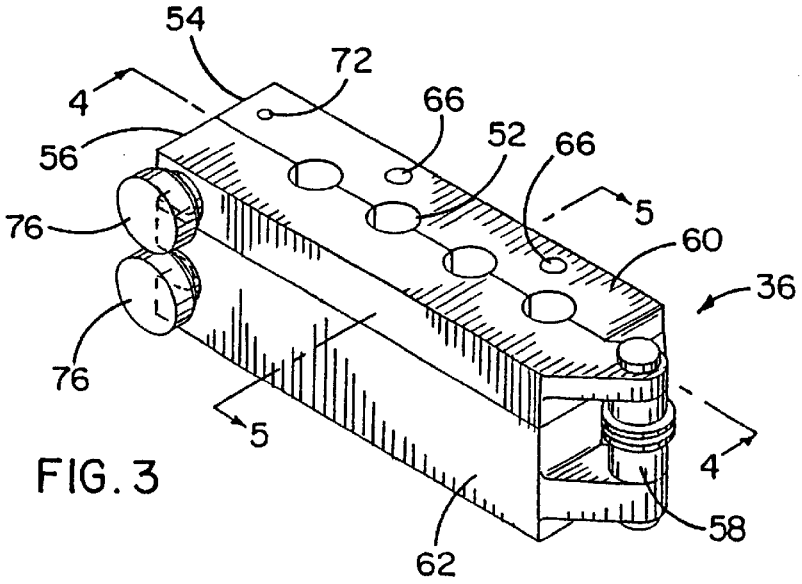
FIG. 3 is a perspective view of the mold used in conjunction with the preferred embodiment of the present invention.
Figure 4:
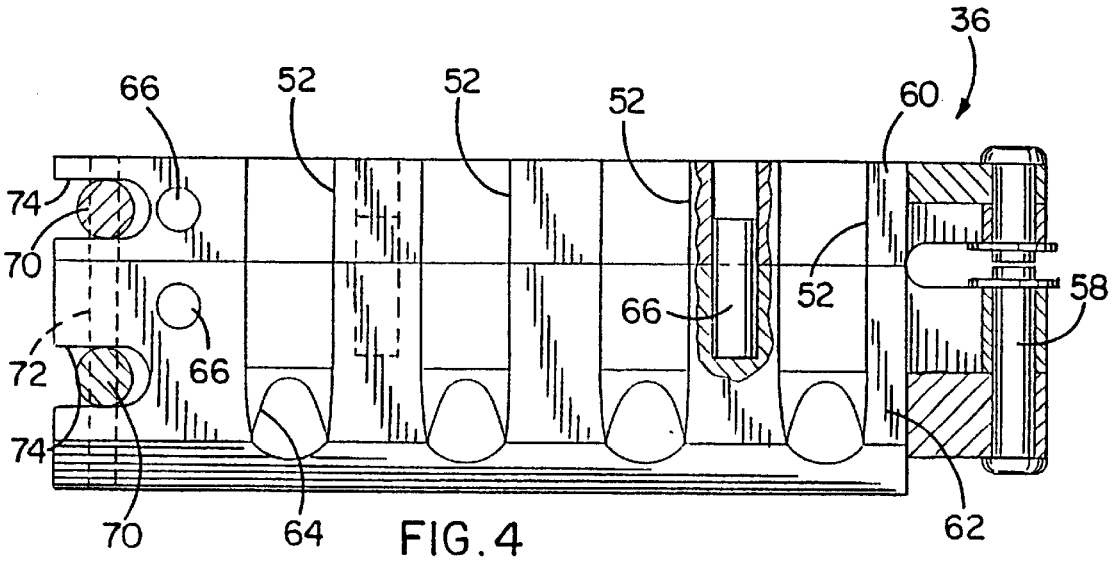
FIG. 4 is a sectional view of the mold shown in FIG. 3 taken along line 4—4.

After blend 46 and base 26 have been heated to the point of liquefaction, the liquefied blend can be poured from heating vessel 34 into mold 36. Alternatively, additional pigments, additives, or frostings can be added after heating to further fine tune the lipstick. More specifically, the liquefied blend 46 can be poured from heating vessel 34 into one of the cavities 52 provided in mold 36. In the preferred embodiment, four cavities 52 are provided, but it is to be understood that in alternative embodiments, the exact number of cavities 52 can vary greatly. As shown in FIGS. 3 and 4, the preferred embodiment of mold 36 is of a clam shell design having first and second mating sides 54 and 56. Sides 54 and 56 are joined by hinge 58 to allow for removal of lipsticks 44. It can also be seen that each side 54 and 56 is comprised of a top portion 60 and bottom portion 62, the importance and function of which will be described in further detail herein. Although only the preferred form of mold 36 is depicted, it is to be understood that a wide range of mold types can be employed including metal molds, plastic molds, single cavity molds, multiple cavity molds, and the like. Such molds need not be in the shape of a conventional lipstick, but can be of the shape of a lip balm jar, tub or the like. Products stored in a lip balm jar which are equivalent to lipstick include lip gloss which is somewhat softer that lipstick in composition and can be applied with a tool or alternatively with a finger. Lipstick, lip gloss and the like can generally be characterized as lip coloring products.

Figure 5:
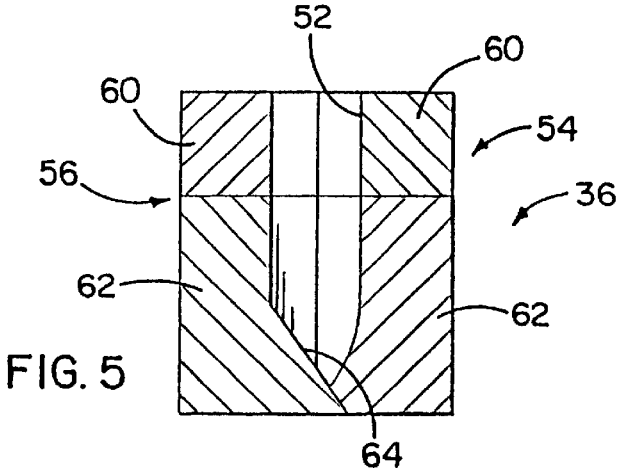
FIG. 5 is a sectional view of the mold taken along line 5—5 of FIG. 3.

With regard to each bottom portion 62 of first and second sides 54 and 56, it can be seen that when brought together in mating orientation, they form cavities 52 having the shape of a conventional lipstick with canted tip 64 (See FIG. 5). It can also be seen that the diameter of cavities 52, as well as the depth of cavities 52 will result in a lipstick 44 having a conventional shape and size. In order to correctly and consistently align first and second side 54 and 56 as well as top and bottom portions 60 and 62, dowels 66 are provided to penetrate through adjacent portions to thereby align adjacent portions and result in uniformly shaped cavities 52. In order to further lock first and second sides 54 and 56 into mating configuration, locking clasps are used to join first side 54 to second side 56 when desired. As best shown in FIG. 4, each locking clasp is comprised of threaded rod 70 which is adapted to pivot about pin 72 attached to first side 54 and pass through channel 74 provided in second side 56. Threaded knob 76 can then be used to attach to rod 70 and be tightened against the outer surface of second side 56 to lock first side 54 and second side 56. Similar locking clasps are provided for top portion 60 and bottom portion 62.

Figure 6:
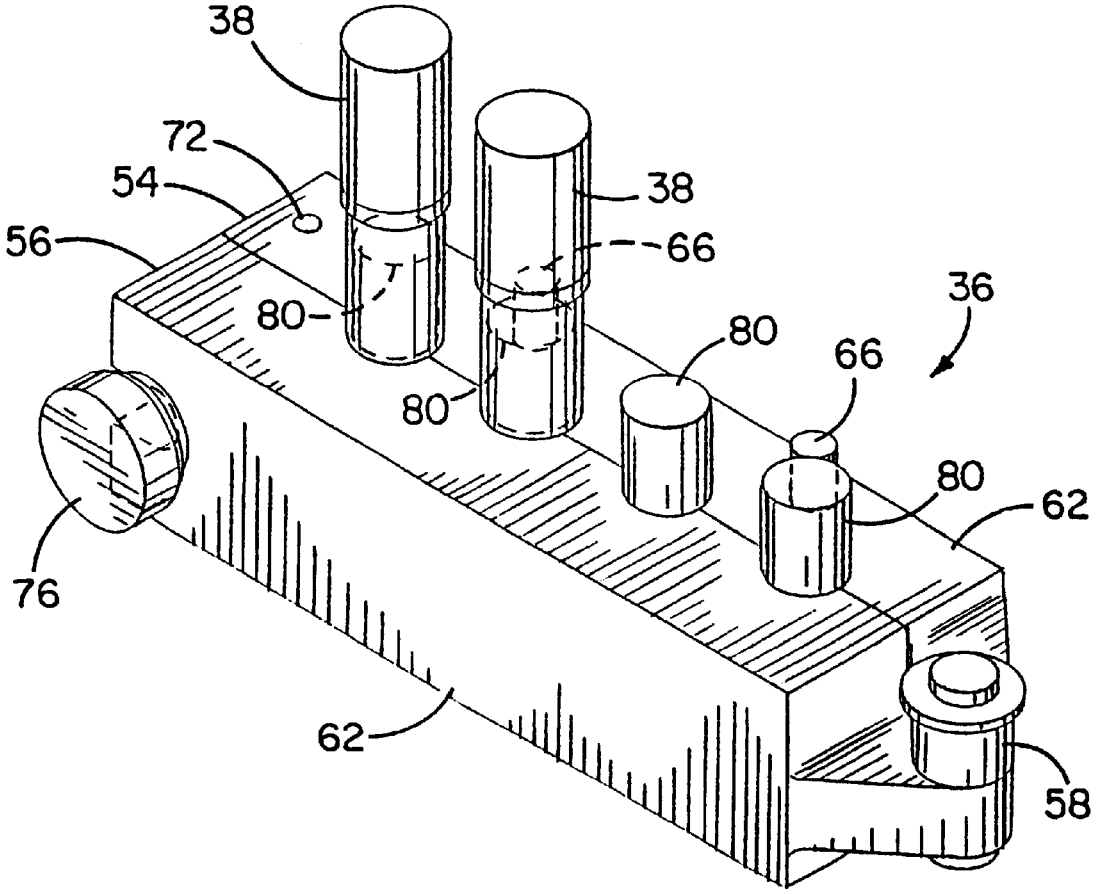
FIG. 6 is a perspective view of the mold after the lipstick blend has been poured and hardened, and after the top layer of the mold has been removed to facilitate attachment of lipstick holding cases to the lipstick.

When it is desired to pour heated blend 46 from vessel 34 into mold 36, first and second sides 54 and 56 will be joined together as will top portions 60 and bottom portions 62 as best shown in FIG. 3. Heated blend 46 will be poured into cavities 52 until full and allowed to cool. In the preferred embodiment, approximately three minutes will be required to allow the heated blend 46 to cool to a hardened state at which time top portion 60 of first side 54 can be loosened from top portion 60 of second side 56. Top portion 60 can then be entirely removed from mold 36 to reveal bottoms 80 of lipsticks 44 as best shown in FIG. 6. At this point, lipstick cases 38, which are of a conventional design, can be pressed down onto bottoms 80 and, given the consistency and texture of lipstick 44, adhered thereto. To facilitate this action, it is desirable that lipstick case 38 be rotated to its uppermost extended position to allow for its base to easily contact bottom 80 of lipstick 44. Alternatively, the hardened lipstick 44 can be re-melted and additional pigments or additives can be added before affixing the lipstick cases 38.

As shown in FIG. 6, upon lipstick case 38 being adhered to lipstick 44, the individual lipsticks 44 can be removed from cavities 52 of bottom portion 62. Case 38 can then be rotated to retract lipstick 44 into case 38 to allow for a cap to be attached thereto. In the preferred embodiment, a non-stick coating is provided on each cavity 52 to facilitate removal of lipsticks 44 from mold 36. In the most preferred embodiment, a non-stick coating similar to Teflon® is used, but other non-stick compounds having similar characteristics can be used with equal efficacy.

From the foregoing, it can therefore be seen that the present invention brings to the art a new and improved apparatus and method by which lipstick can be custom blended, at a retail counter, or at home for personal use, and fabricated into a conventional lipstick case for use in a matter of minutes. Such a kit not only greatly expands the ability of a retail outlet to tailor its supply to the specific demands of the individual customer, but greatly enhances the satisfaction of the individual customer by quickly providing the exact shade and consistency of lipstick desired without the time consuming and often futile process of visiting multiple retailers and searching through expansive volumes of lipstick inventory. Moreover, once a particular lipstick is created, its recipe can be recorded for subsequent batch creation to thereby avoid reliance on a particular manufacturer which subsequently discontinues a desired type of lipstick.

It will also be appreciated that in another embodiment, one or each of the containers used for the bases may double as a heating vessel for use in heating the lip coloring product to a liquefied form. The mold itself could also be utilized as a heating vessel if so desired. Regular household items could also be selected for use as a heating vessel.

What is claimed is:

1. A kit for custom blending lip coloring product to a desired shade, texture, and content, the kit comprising:

a plurality of containers containing pigments adapted to be blended together to create a particular shade of lip coloring product;

at least one container containing at least one base adapted to be blended with selected pigments to provide a particular texture and consistency for lip coloring product;

means for measuring pre-determined quantities of selected pigments and the at least one base, the quantities of the pigments and the at least one base adapted to be heated to form a desired blend of lip coloring product in liquefied form; and a mold adapted to receive the desired blend in liquefied form, the mold adapted to extract heat from the liquefied desired blend until the desired blend hardens into lip coloring product; and wherein the plurality of containers; the measuring means and the mold are packaged together in the kit for resale at a point of purchase, with the at least one base and the pigments stored separately in the containers.

2. The kit of claim 1 further including a plurality of additives adapted to be added to the desired blend, the additives being selected from the group consisting of moisturizes, sunscreens, scents, and frost type pigments.

3. The kit of claim 1 wherein the measuring means is one selected from the group consisting of a blending sheet with multiple graduated areas, at least one scoop, at least one spoon, a scale, at least one dropper, at least one measuring cup, and at least one metering device.

4. The kit of claim 1 further comprising a heating vessel adapted to receive the desired blend, the heating vessel being suitable for use with a heating means that is intended for use with the kit for liquefying the pigments and bases.

5. The kit of claim 4 wherein the heating means for which the heating vessel is suitable is selected from the group consisting of a heating block, a steam bath, a water bath, a microwave oven, an oven, a flame, and a hot air blower.

6. The kit of claim 1 wherein the mold is a lip balm jar.

7. The kit of claim 1 wherein the mold includes a clam shell type housing having first and second mating sides, the sides being hingedly attached and adapted to be folded together to form at least one lipstick cavity, the lipstick cavity adapted to receive the liquefied desired blend for forming a lipstick.

8. The kit of claim 7 wherein the clam shell mold first and second sides each include top portions and bottom portions, the first side top portion being hinged to the second side top portion, the first side bottom portion being hinged to the second side bottom portion, the top portions adapted to be removed after the desired blend hardens to facilitate attachment of an extendible and retractable lipstick case to the lipstick.

9. The kit of claim 8 wherein the mold includes clamping means to retain the mold in a closed position during hardening of the lipstick.

10. The kit of claim 8 wherein the top and bottom portions include apertures adapted to align and receive dowels therein to ensure proper alignment of the top and bottom portions.

11. The kit of claim 7 further comprising at least one extendible lipstick case adapted to house the hardened lipstick.

12. The kit of claim 1 wherein the at least one container for the base is a heating vessel in which the at least one base and at least one of the pigments are mixed.

13. The kit of claim 1 wherein the at least one base is unshaded and not shaded to a particular hue.

14. The kit of claim 1 wherein the measuring means comprises a measuring sheet having a plurality of graduated segments, said pigments being measured in the graduated segments of the measuring sheet.

15. The kit of claim 14 further comprising a mixing tool adapted to blend pigments measured in the graduated segments.

16. The kit of claim 15 further comprising a transparent blending sheet adapted to cover the remeasuring sheet.

17. The kit of claim 1 wherein the pigments are contained separately from the at least one base, the pigments being pourable and adapted to be mixed with other pigments.

18. A kit for custom blending lip coloring product to a desired shade, texture, and content, the kit comprising:

a plurality of pigments adapted to be blended together to create a particular shade of lip coloring product;

at least one base adapted to be blended with selected pigments to provide a particular texture and consistency for lip coloring product;

at least one measurer adapted to measure quantities of selected pigments, the quantities of selected pigments adapted to be mixed with the at least one base;

a mold adapted to receive the base and the quantities of selected pigments; and wherein said plurality of pigments are stored separately from the at least one base and packaged together along with the at least one measurer and the mold in the kit for resale at a point of purchase.

19. The kit of claim 18 further comprising a mixing tool adapted to mix the at least one base and selected ones of the plurality of pigments.

20. The kit of claim 18 further comprising at least one fragrance adapted to be mixed with the at least one base and the quantities of selected pigments.

21. The kit of claim 20 wherein the at least one fragrance comprises a plurality of fragrances.

22. The kit of claim 18 wherein the mold is a lip balm jar.

23. The kit of claim 18 wherein the mold is a lipstick mold comprising a top and bottom shell having an internal cavity therebetween for forming a lipstick, further comprising at least one extendible lipstick case adapted to house the lipstick.

24. The kit of claim 18 further comprising at least one frost type pigment adapted to be blended with the at least one base and the selected quantities of pigments.

25. The kit of claim 18 wherein the at least one base is unshaded and not shaded to a particular hue.

26. The kit of claim 18 wherein the at least one measurer comprises a measuring sheet having a plurality of graduated segments, said pigments being measured in the graduated segments of the measuring sheet.

27. The kit of claim 26 further comprising a mixing tool adapted to blend pigments measured in the graduated segments.

28. The kit of claim 27 further comprising a transparent blending sheet adapted to cover the measuring sheet.

29. The kit of claim 18 wherein the pigments are stored separately from the at least one base, the pigments being pourable and adapted to be mixed with other pigments.

* * * * *

UNITED STATES PATENT AND TRADEMARK OFFICE

CERTIFICATE OF CORRECTION

PATENT NO. : 6,402,120 B1
DATED : June 11, 2002
INVENTOR(S) : Mary Swaab

It is certified that error appears in the above-identified patent and that said Letters Patent is hereby corrected as shown below:

Column 8,
Line 64, change "remeasuring" to -- measuring --.

Signed and Sealed this

Thirtieth Day of July, 2002

*Attest:*

*Attesting Officer*

JAMES E. ROGAN
*Director of the United States Patent and Trademark Office*

US006402120C1

(12) EX PARTE REEXAMINATION CERTIFICATE (8018th)

United States Patent

Swaab

(10) Number: US 6,402,120 C1

(45) Certificate Issued: Feb. 8, 2011

(54) APPARATUS FOR BLENDING AND FABRICATING PERSONALIZED LIPSTICK

(75) Inventor: Mary Swaab, Rockford, IL (US)

(73) Assignee: Colorlab Cosmetics, Inc., Rockford, IL (US)

Reexamination Request:
No. 90/008,988, Jan. 10, 2008

Reexamination Certificate for:

| | |
|---|---|
| Patent No.: | **6,402,120** |
| Issued: | **Jun. 11, 2002** |
| Appl. No.: | **09/363,129** |
| Filed: | **Jul. 28, 1999** |

Certificate of Correction issued Jul. 30, 2002.

Related U.S. Application Data

(63) Continuation-in-part of application No. 08/924,196, filed on Sep. 5, 1997, now Pat. No. 5,971,351.

(51) Int. Cl.
*B29C 39/00* (2006.01)

(52) U.S. Cl. ..... 249/117; 206/568; 206/575; 206/581; 249/119; 249/170

(58) Field of Classification Search ..... None
See application file for complete search history.

(56) References Cited

U.S. PATENT DOCUMENTS

| | | | |
|---|---|---|---|
| 4,403,866 | A | 9/1983 | Falcoff et al. |
| 4,611,611 | A | 9/1986 | Beal, Jr. |
| 4,871,262 | A | 10/1989 | Krauss et al. |
| 4,998,617 | A | 3/1991 | Ladd, Jr. et al. |
| 5,066,216 | A | 11/1991 | Kowtko et al. |
| 5,160,689 | A | 11/1992 | Kamen |
| 5,163,010 | A | 11/1992 | Klein et al. |
| 5,316,398 | A | 5/1994 | Chandaria et al. |
| 5,903,465 | A | 5/1999 | Brown |
| 5,924,426 | A | 7/1999 | Galazin |
| 5,945,115 | A | 8/1999 | Dunn et al. |
| 6,050,540 | A | 4/2000 | O'Reilly |
| 6,177,093 | B1 | 1/2001 | Lombardi et al. |

OTHER PUBLICATIONS

"Blister Pack", Definition, Merrian–Webster OnLine Dictionary, Feb. 6, 2009.*
"Package", Definition, Merriam–Webster Online Dictionary, Feb. 6, 2009.*
"Costmetic Recipes", [online]. © 1996 Stony Mountain Botanicals. [retrieved on Dec. 17, 2007]. Retrieved from the Internet: <URL: http://www.wildroots.com/costmetic.htm>, 10 pgs.
"Cutting Edge Advertisement", *American Salon*, (Jun. 1994), 3 pgs.
"Fall Preview", *The Upper East Side Resident*, (Aug. 30–Sep. 5, 1995), 1 pg.
"Information re: Custom–blended cosmetics (lipstick produced by Luminique)", *The News Times Sunday*, (Oct. 15, 1995), 1 pg.
"Yardley Pot o' Gloss™ Advertisement", *Seventeen Magazine*, (Dec. 1971),2 pgs.
"Yardley Pot o' Gloss™ Advertisement", *Seventeen Magazine*, (Oct. 1971), 2 pgs.
"Yardley Pot o' Gloss™ Advertisment—How to Make the Most of Your Lips", *Teen Magazine*, (May, 1972), 2 pgs.
U.S. Appl. No. 10/119,117, filed Apr. 9, 2002, Swaab.
U.S. Appl. No. 11/036,831, filed Jan. 14, 2005, Swaab.
Jean Putz, Christine Niklas, *Schminken, pflegen schones Haar, Sanfte Kosmetik und Sonnenklosmetik*, Jan. 1993, 18 pages. Printed in Germany, Exhibit A.
Andree Rechsteiner, Kosmetik rezeptbuch, Fischer, 1995, 7 pages, Exhibit B.
Spinnrad Die Drogerie Fur Umwelt Un Soziale Verantwortung, undated, 4 pages of a Brochure, Exhibit C.
Spinnrad Die Sanfte Drogerie, Cat. No. 30, 1993/94, 3 pages of a Brochure, Exhibit C–1.
Cosmetic Zum Selbermachen, Cosmega, 91/1992, 6 pages of a Brochure, Exhibit D.
Die letzten Preise ohne MWST., Cosmega, 1994, 8 pages of a Brochure, Exhibit E.
Hobbythek–Substanzen Frischocosmetic Zuboher Waschmittel–Baukasten, Cosmetic System, Jan. 1992, 5 pages of a Brochure, Exhibit F.
Kosmetik zum Selbermachen Interwega Handels AG, Cosmetic System, Aug. 1992, 6 pages of a Brochure, Exhibit G.
Kosmetik zum Selbermachen Interwega Handels AG, Cosmetic System, 94–95, 4 pages of a Brochure, Exhibit G–1.
Kosmetik zum Selbermachen Preisliste, Colimex, Sep. 1990, 5 pages of a Brochure, Exhibit H.
Hobbythek–Rohstoffe Atherische Ole Waschmittel–Baukasten Krauter Und Gewurze, Omikron, undated, 7 pages of a brochure, Exhibit I.
Fur Umwelt Und Soziale Verantwortung, Spimmrad Die Drogerie, Cat. No. 33, 1995, 5 pages of a Brochure, Exhibit J.

* cited by examiner

*Primary Examiner*—Brenda Brumback

(57) ABSTRACT

An apparatus and method for custom blending and fabricating lipstick to the specific demands of individual customers. The present invention provides a kit which enables a user to blend various pigments to arrive at a very specific shade, and then blend the desired shade with a specific base to result in a desired consistency of lipstick, and which also allows the blended bases and pigments to be heated to a liquefied form and poured into a mold for hardening. Upon cooling and hardening, a conventional lipstick case can be attached to the lipstick for removal from the mold and use by the customer. The present invention therefore not only allows a user to quickly attain the specific shade and consistency of lipstick desired, but also eliminates the time consuming and unsatisfactory process of visiting multiple stores having expansive inventories of variously shaded and textured lipsticks.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 6, 18, 22 and 29 are cancelled.

New claims 30-39 are added and determined to be patentable.

Claims 2-5, 7-17, 19-21 and 23-28 were not reexamined.

*30. The kit of claim 1, wherein the measuring means contacts the pigments when in use.*

*31. The kit of claim 30, wherein the measuring means comprises at least one dropper.*

*32. The kit of claim 31, wherein the at least one dropper is carried by one of the containers.*

*33 . The kit of claim 1, wherein the containers for the pigments are stored upright and have a dispensing end at a top thereof at a neck region of the containers.*

*34. The kit of claim 1, wherein the pigments include colors and frostings, the frostings stored separately from the colors.*

*35. The kit of claim 18, wherein the measurer contacts the pigments when in use.*

*36. The kit of claim 35, wherein the measurer comprises at least one dropper.*

*37. The kit of claim 36, wherein the at least one dropper is carried by one of the containers containing pigments.*

*38. The kit of claim 18, further comprising containers storing the pigments, each container being stored upright and having a dispensing end at a top thereof at a neck region of the containers.*

*39. The kit of claim 18, wherein the pigments include colors and frostings, the frostings stored separately from the colors.*

* * * * *